US007121222B1

(12) United States Patent
Johnston

(10) Patent No.: US 7,121,222 B1
(45) Date of Patent: Oct. 17, 2006

(54) ANCHOR ASSEMBLY AND METHOD

(76) Inventor: Ray K Johnston, 24 Currier Rd., Candia, NH (US) 03034

( * ) Notice: Subject to any disclaimer, the term of this patent is extended or adjusted under 35 U.S.C. 154(b) by 0 days.

(21) Appl. No.: 11/065,662

(22) Filed: Feb. 25, 2005

(51) Int. Cl.
*B63B 21/24* (2006.01)

(52) U.S. Cl. ..... 114/293; 114/294; 114/310

(58) Field of Classification Search ..... 114/293, 114/294, 310, 315; 441/21, 26; 242/156, 242/371, 385, 386, 388, 403, 405, 405.2, 242/398, 400, 400.1, 404, 404.3, 405.3
See application file for complete search history.

(56) References Cited

U.S. PATENT DOCUMENTS 2,747,814 A * 5/1956 Taylor ..... 242/379.2
3,395,668 A * 8/1968 George ..... 114/294
3,423,044 A * 1/1969 Beiderwell ..... 242/396.9
3,704,538 A * 12/1972 Gagnon ..... 43/3
D285,646 S 9/1986 Hahn et al.
4,729,331 A * 3/1988 Eggleston ..... 114/230.26
5,062,375 A 11/1991 Makielski
5,173,067 A * 12/1992 Biba ..... 441/25
5,275,379 A 1/1994 McAleer
5,342,229 A * 8/1994 Whitt ..... 441/6
5,730,425 A 3/1998 Brooks
5,779,226 A 7/1998 Wudtke
5,803,008 A 9/1998 Georgens et al.
5,862,771 A 1/1999 Lange et al.

* cited by examiner

*Primary Examiner*—Ed Swinehart

(57) ABSTRACT

An anchor assembly and method includes a boat that has a length less than 15 feet. A catch is attached to the boat. A housing has a first side wall, a second side wall and a peripheral wall extending there between. A spool is rotatably mounted in the housing. A rotation of the spool is biased in a first direction. The peripheral wall has an opening therein. A tether is attached to the spool and has a free end extending outwardly through the opening. The spool rotates in a second direction as the tether is extended outwardly of the housing. An anchor is attached to the tether. A clasp attached to the housing is attached to the catch. The tether is released outward of the opening so that the anchor falls into a body of water and comes to rest on a bottom surface of the body of water.

6 Claims, 3 Drawing Sheets

ANCHOR ASSEMBLY AND METHOD

BACKGROUND OF THE INVENTION

1. Field of the Invention

The present invention relates to anchor devices and more particularly pertains to a new anchor device for attaching to a lightweight watercraft and which may easily transported when not in use.

2. Description of the Prior Art

The use of anchor devices is known in the prior art. U.S. patent No. describes a device adapted for retrieving and storing an anchor line of an offshore drilling platform. Another type of anchor device is U.S. Pat. No. 5,862,771 which includes a device adapted for tightening or releasing a mooring line. Yet another such device is U.S. Pat. No. 5,275,379 which includes a chain hoist mechanism having a structure adapted for lifting a chain having variously sized chain links. U.S. Pat. Des. No. 285,646 includes an anchor having a pulley built therein for easy retrieval of the anchor.

While these devices fulfill their respective, particular objectives and requirements, the need remains for a device that allows a person to easily transport and attach a relatively lightweight anchor to a small watercraft or flotation apparatus. The device should include a self-retracting tether attached to an anchor to allow a person to retrieve the tether and easily store the device.

SUMMARY OF THE INVENTION

The present invention meets the needs presented above by comprising a boat that has a length less than 15 feet. At least one catch is attached to the boat. A housing has a first side wall, a second side wall and a peripheral wall extending there between. A spool is rotatably mounted in the housing. A rotation of the spool is biased in a first direction. The peripheral wall has an opening therein. A tether is attached to the spool and has a free end extending outwardly through the opening in the peripheral wall. The spool rotates in a second direction as the tether is extended outwardly of the housing and rotates in the first direction when the tether is pulled into the housing. An anchor is attached to the tether. A clasp is attached to the housing. The clasp is attached to the catch so that the housing is secured to the boat. The tether is released outward of the opening so that the anchor falls into a body of water and comes to rest on a bottom surface of the body of water. The anchor may be lifted upwardly off of the bottom surface at a selected time so that the tether is pulled into the housing by the spool.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
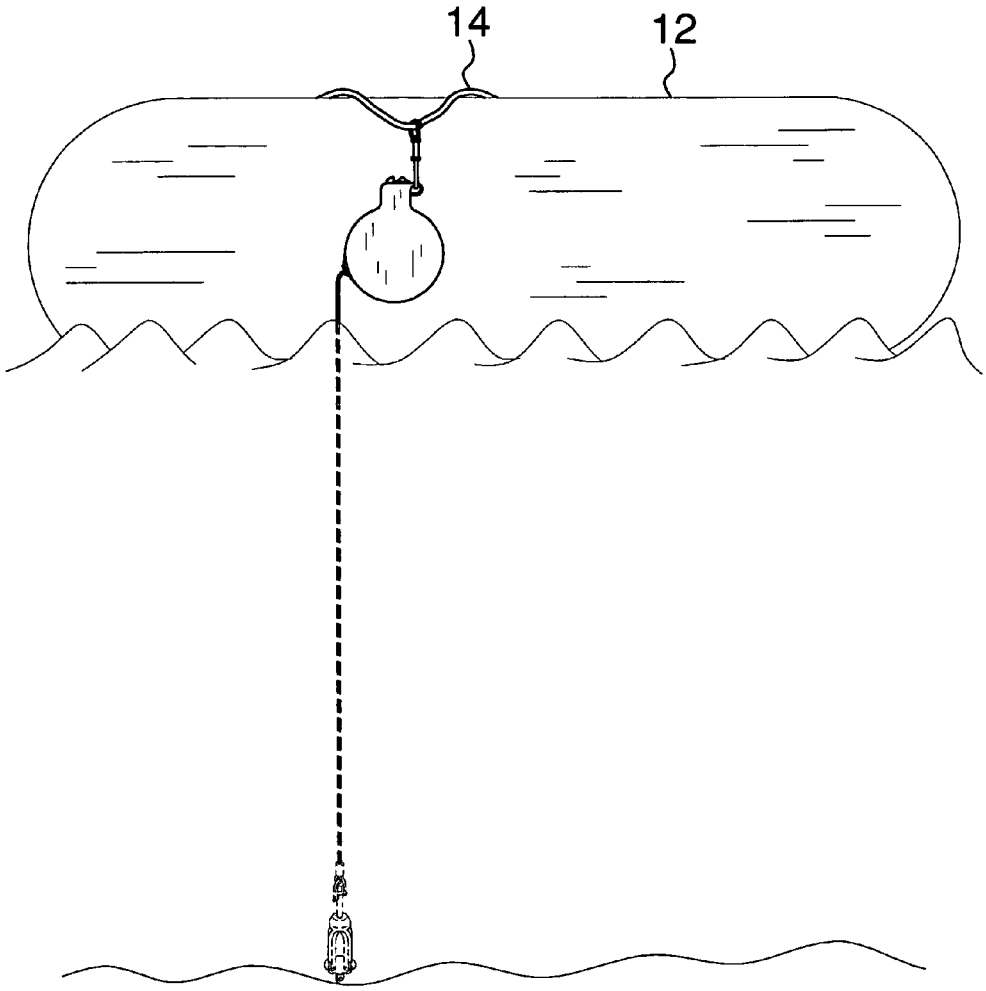
FIG. 1 is a side in-use view of a anchor assembly and method according to the present invention.
Figure 2:
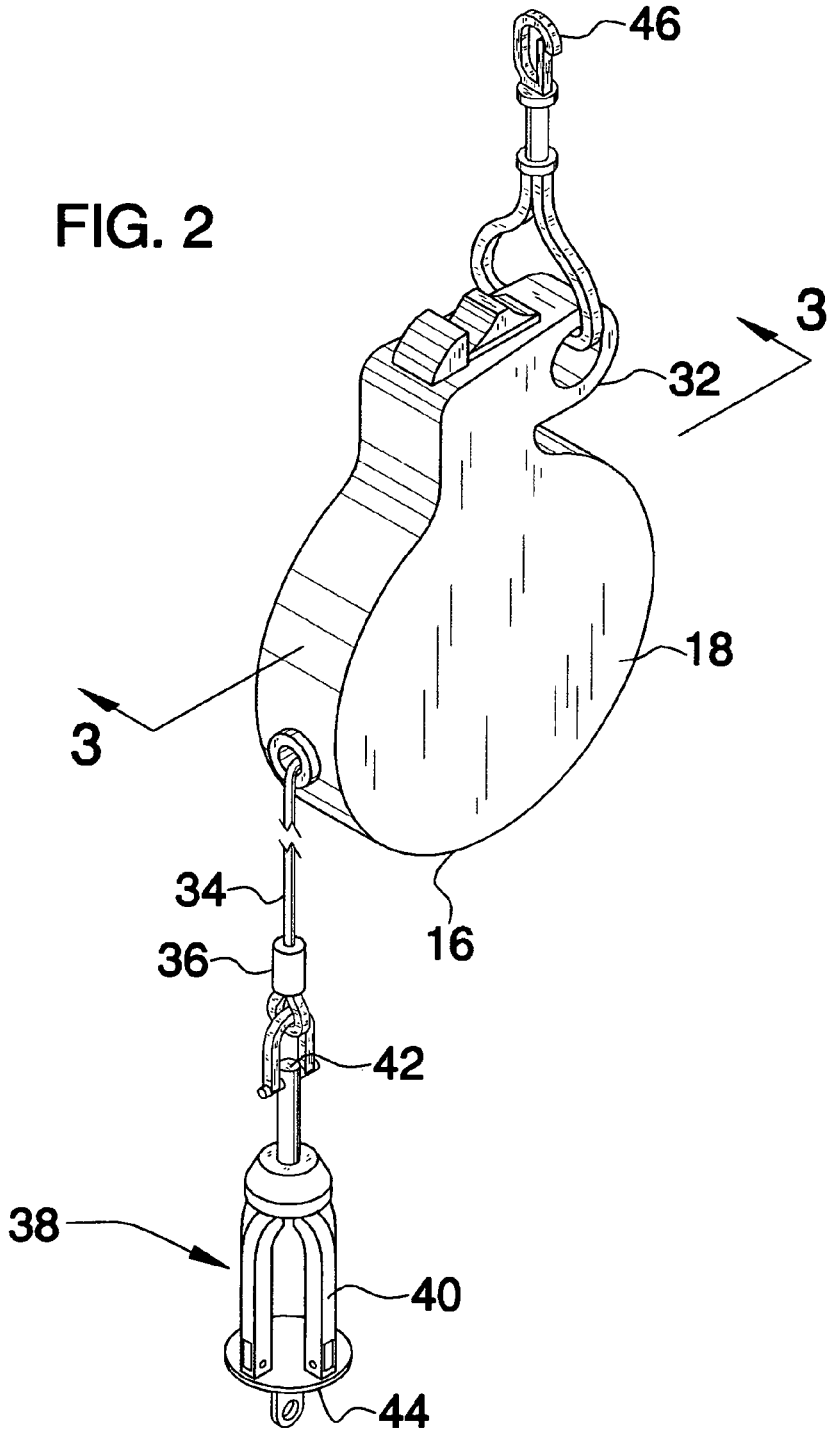
FIG. 2 is a perspective view of the present invention.
Figure 3:
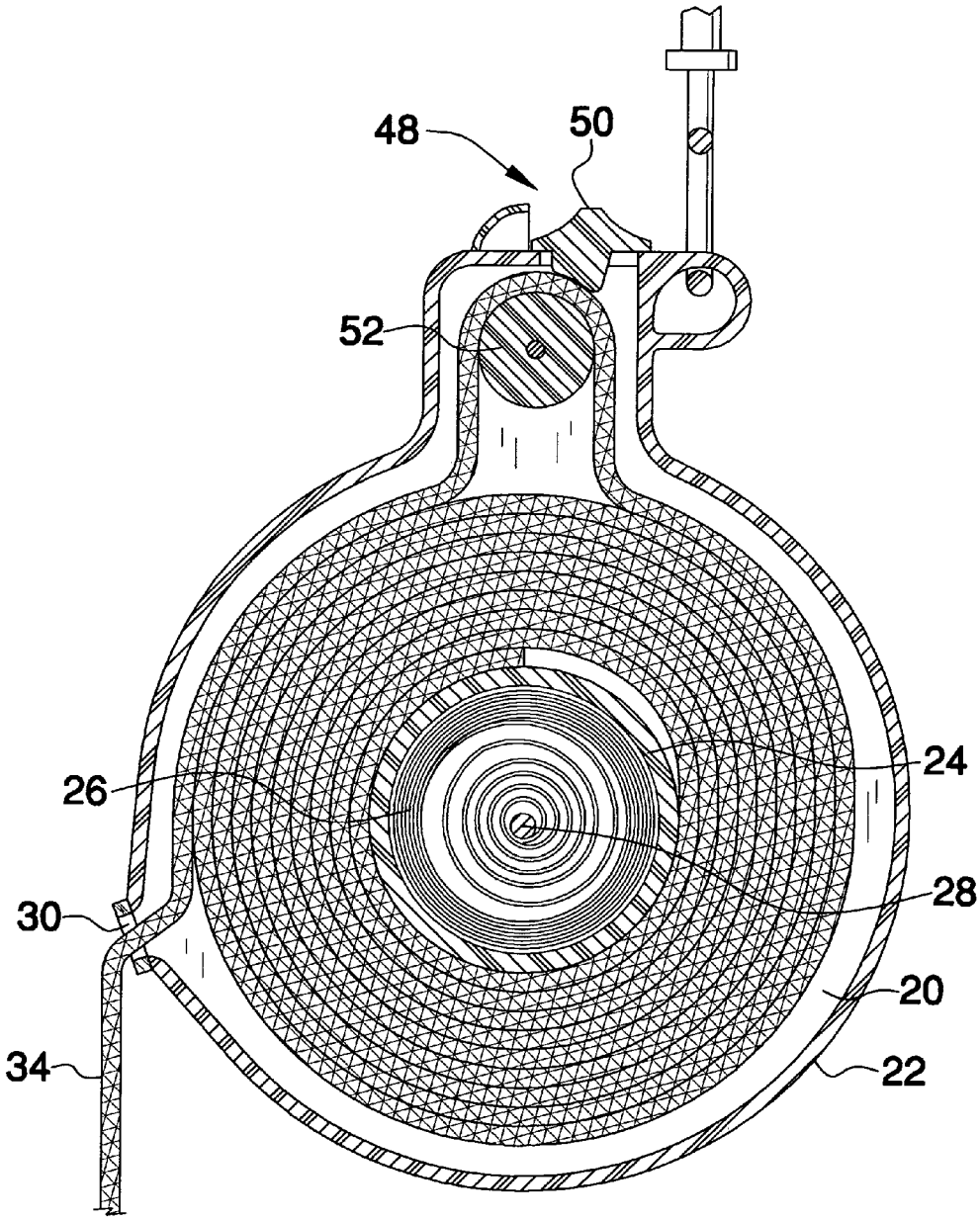
FIG. 3 is a cross-sectional view taken along line 3—3 of FIG. 2 of the present invention.

With reference now to the drawings, and in particular to FIGS. 1 through 3 thereof, a new anchor device embodying the principles and concepts of the present invention and generally designated by the reference numeral 10 will be described.

As best illustrated in FIGS. 1 through 3, the anchor assembly and method 10 generally comprises a device used for a boat 12 having a length less than 15 feet. Such boats 12 include inflatable boats, kayaks, canoes and the like. More generally, the term "boats" may be used to include large flotation devices such as an inner tube. At least one catch 14 is attached to the boat 12. The catch 14 can be any common handhold or other coupler on a boat 12.

A housing 16 has a first side wall 18, a second side wall 20 and a peripheral wall 22 extending there between. A spool 24 is rotatably mounted in the housing 16. A rotation of the spool 24 is biased in a first direction by a spring 26 attached to and wound about a rod 28 mounted in the housing 16 and positioned within the spool 24. The peripheral wall 22 has an opening 30 therein. A handle 32 is attached to the peripheral wall 22.

A tether 34 is attached to the spool 24. The tether 34 has a free end 36 extending outwardly through the opening 30 in the peripheral wall 18. The spool 24 rotates in a second direction as the tether 34 is extended outwardly of the housing 16 and rotates in the first direction when the tether 34 is pulled into the housing 16. The tether 34 has a length less than thirty feet.

An anchor 38 is attached to the free end 36 of the tether 34. The anchor 38 has a weight less than eight pounds and includes a central section 40 that has an upper side 42 and a lower side 44. The free end 36 is positioned adjacent to the upper side 42.

A clasp 46 is attached to the housing 16. The clasp 46 is positioned on the handle 32. The clasp 46 can include any conventional clasp and is preferably biased in a closed position so that it may be attached securely to the catch 14 or other object.

A locking assembly 48 is attached to the housing 16 and is in communication with the housing 16 for selectively locking a position of the tether 34 with respect to the housing 16. The locking assembly 48 is positionable in a locked position preventing movement of the tether 34 through the opening 30 or in an open position allowing movement of the tether 34 through the opening 30. The locking assembly 48 includes an actuator 50 that is abuttable against a portion of the tether 34 to secure the tether 34 between the actuator 50 and a post 52 mounted in the housing 16. The actuator 50 may be slid into the locked position abutting the tether 34 and held there in place by the tension of the tether 34 pressing against the post 52 and the actuator 50.

In use, the clasp 46 is attached to the catch 14 so that the housing 16 is secured to the boat 16. The tether 34 is released outward of the opening 30 so that the anchor 38 falls into a body of water and comes to rest on a bottom surface of the body of water. At a selected time, the anchor 38 is lifted upward off of the bottom surface so that the tether 34 is pulled into the housing 16 by the spool 24 and into a stored position wound about the spool 24. This allows the anchor 38 to be easily transported as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A watercraft anchoring system, comprising:

a housing having a first side wall, a second side wall and a peripheral wall extending therebetween and defining an interior, a dispensing opening being positioned in said peripheral wall and extending into said interior;

a spool being rotatably mounted in the interior of said housing;

biasing means for biasing rotation of said spool in a first direction, said biasing means being positioned in the interior of said housing;

a tether cord attached to and wrapped about the spool, a portion of said tether cord extending through the dispensing opening in said housing such that rotation of said spool in a first direction retracts said tether cord into said housing and rotation of said spool in a second direction extends said tether cord out of said housing;

a handle formed on said housing, said handle being located on the peripheral wall of said housing, said handle being located at a position approximately 120 degrees from the dispensing opening in said housing with respect to an axis of rotation of said spool, said handle forming a loop;

a clasp attached to said housing for receiving a catch attached to said watercraft, said clasp being attached to the loop of said handle such that said clasp is located at a position approximately 120 degrees from the dispensing opening in said housing with respect to an axis of rotation of said spool;

an anchor attached to a free end of said tether cord positioned outside of said housing;

a securing assembly attached to said housing for selectively securing a portion of the tether cord against movement out of the dispensing opening in said housing, said securing assembly being positionable in a secured position preventing movement of said tether cord through said opening or in a released position allowing movement of the portion of said tether cord through said dispensing opening, said securing assembly comprising an actuator slidably mounted on said handle to permit a hand to grip said handle and slide the actuator while the hand grips said handle.

2. The system of claim 1 additionally comprising a watercraft configured to support a person.

3. The system of claim 2 wherein said watercraft comprises a boat.

4. The system of claim 2 wherein said watercraft comprises a kayak.

5. The system of claim 2 wherein said watercraft comprises an inflatable boat.

6. The system of claim 1 wherein said biasing means comprises a spring.

* * * * *